US005462420A

United States Patent [19]

Stehr et al.

[11] Patent Number: 5,462,420

[45] Date of Patent: Oct. 31, 1995

[54] GEAR PUMP

[75] Inventors: Roger Stehr, Buelach; Urs Boelsterli, Bassersdorf, both of Switzerland

[73] Assignee: Maag Pump Systems AG, Zurich, Switzerland

[21] Appl. No.: 167,079

[22] Filed: Dec. 15, 1993

[30] Foreign Application Priority Data

Dec. 16, 1992 [CH] Switzerland ..... 92 17 162.7 U

[51] Int. Cl.[6] ..... F01C 19/00

[52] U.S. Cl. ..... 418/83; 418/141; 277/16; 277/22; 277/134

[58] Field of Search ..... 418/83, 141, 205, 418/206; 277/16, 22, 53, 134, 203

[56] References Cited

U.S. PATENT DOCUMENTS

| | | | |
|---|---|---|---|
| 1,072,421 | 9/1913 | Brown | 277/134 |
| 3,473,474 | 10/1969 | Martinaglia | 418/206 |
| 3,945,779 | 3/1976 | Vlemmings et al. | 418/206 |
| 3,976,405 | 8/1976 | Geiger et al. | 418/102 |
| 4,293,291 | 10/1981 | Link | 418/104 |
| 4,336,213 | 6/1982 | Fox | 418/191 |
| 4,471,963 | 9/1984 | Airhart | 217/134 |

FOREIGN PATENT DOCUMENTS

| | | |
|---|---|---|
| 4125128A | 2/1992 | Germany . |
| 2202005A | 9/1988 | United Kingdom . |

*Primary Examiner*—Richard A. Behisch
*Assistant Examiner*—Charles G. Freay
*Attorney, Agent, or Firm*—Evenson McKeown Edwards & Lenahan

[57] ABSTRACT

A gear pump comprising a housing for housing gear pump rotors in a housing interior, said housing having a housing end at an end face side of the housing through which at least one pump rotor shaft is guided from the housing interior to outside the housing, a shaft bearing in the housing end for rotatably supporting the rotor shaft, and a labyrinth seal in the housing end which in use surrounds the rotor shaft, wherein the shaft bearing is arranged separately from the labyrinth seal at a position spaced axially inward toward the housing interior with respect to the labyrinth seal.

15 Claims, 2 Drawing Sheets

GEAR PUMP

BACKGROUND AND SUMMARY OF THE INVENTION

The present invention relates to a gear pump of the type which includes a housing for housing gear pump rotors in a housing interior, said housing having a housing end at an end face side of the housing through which at least one pump rotor shaft is guided from the housing interior to the outside. A shaft bearing is arranged in the housing end. In the case of gear pumps of the above-mentioned type, it is known to seal off by means of labyrinth seals rotor shafts which extend to the outside.

Thus, it is known from U.S. Pat. No. 4,336,213 to extend the shaft of a rotor toward the outside for driving purposes. For these purposes, one of the two bearing covers is constructed in two parts. This is usually the axial housing end which is normally screwed to the central part of the housing, viewed in the direction of the rotor axes. The shaft, which extends axially through the cover, enters a separate bearing and sealing part which has a bearing function as well as a sealing function. The receiving bore for the shaft on the bearing/sealing part has a labyrinth seal, that is, a hydrodynamic seal. This type of construction has several disadvantages:

a) The above-mentioned bearing/sealing part or its receiving bore for the shaft, on the one hand, acts as a bearing shell; on the other hand, it acts together with the labyrinth seal as a sealing element along its whole axial section. It is extremely problematic in many of the common types of application or constructions of gear pumps to provide the bearing shells for the rotors with the grooves required for a labyrinth seal; for example, for reasons of surface stress to the screw-shaped contact surface of the bearing shell which, as a result, is increased in a pronounced manner.

b) Obviously, because the manufacturing of the bearing/sealing surface with the integrated labyrinth seal is considered to be so problematic that for this purpose a separate part is provided as the rotation body which is accessible to a relatively easy machining, it is accepted that the bearing cover is to be fastened on the central housing in a sealing manner with the necessity of a corresponding number of fastening anchors, and that, in addition, the cylindrical bearing/sealing part in the bearing cover is to be mounted by means of additional fastening elements, and that additional surfaces are to be sealed, specifically between the bearing/sealing part and the bearing cover.

It is an object of the invention to eliminate these disadvantages. According to the invention, these disadvantages are eliminated by providing a gear pump wherein the shaft bearing is arranged separately from the labyrinth seal at a position spaced axially inward toward the housing interior with respect to the labyrinth seal.

Because of the fact that the bearing of the shaft is arranged in a separate bearing section in the housing axially on the inside and the labyrinth seal axially adjoins the bearing section, a clear separation of functions is achieved for the bearing of the shaft and for the sealing so that the bearing shells can be designed without being impaired by a groove profile and, on the other hand, the labyrinth seal can correspond exclusively to its inherent function, specifically the sealing function.

In contrast to the common assumption that, because of its difficult design, the labyrinth seal is to be provided on a cylindrical bush which is specifically provided for it, which however, requires the acceptance of the above-mentioned problems with respect to the mounting expenditures and the sealing surface, it is further suggested in preferred embodiments of the invention to work the labyrinth seal directly into the shaft receiving opening in the bearing cover.

If, for example, for reasons of wear, it is endeavored in this case to manufacture the labyrinth seal shells of a different material, such as a ceramic material or of special steel, and not of the same material as the housing cover, it is suggested according to preferred embodiments of the invention to provide a bush with the labyrinth seal in the shaft receiving opening on the housing cover by means of pressing, welding or gluing.

A particularly simple solution is achieved according to preferred embodiments of the invention by the fact that the labyrinth seal is worked directly into the wall of the shaft receiving opening on the housing cover.

Furthermore, by developing the gear pump with a cooling duct system in the housing cover, the effect of the labyrinth seal can be adapted to the respective delivered medium.

By designing the housing end as a plate in which the labyrinth seal as well as the bearing section are housed in certain preferred embodiments of the invention, the number of surfaces to be sealed will be reduced further and the flexibility is increased further, for example, with respect to inspections.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
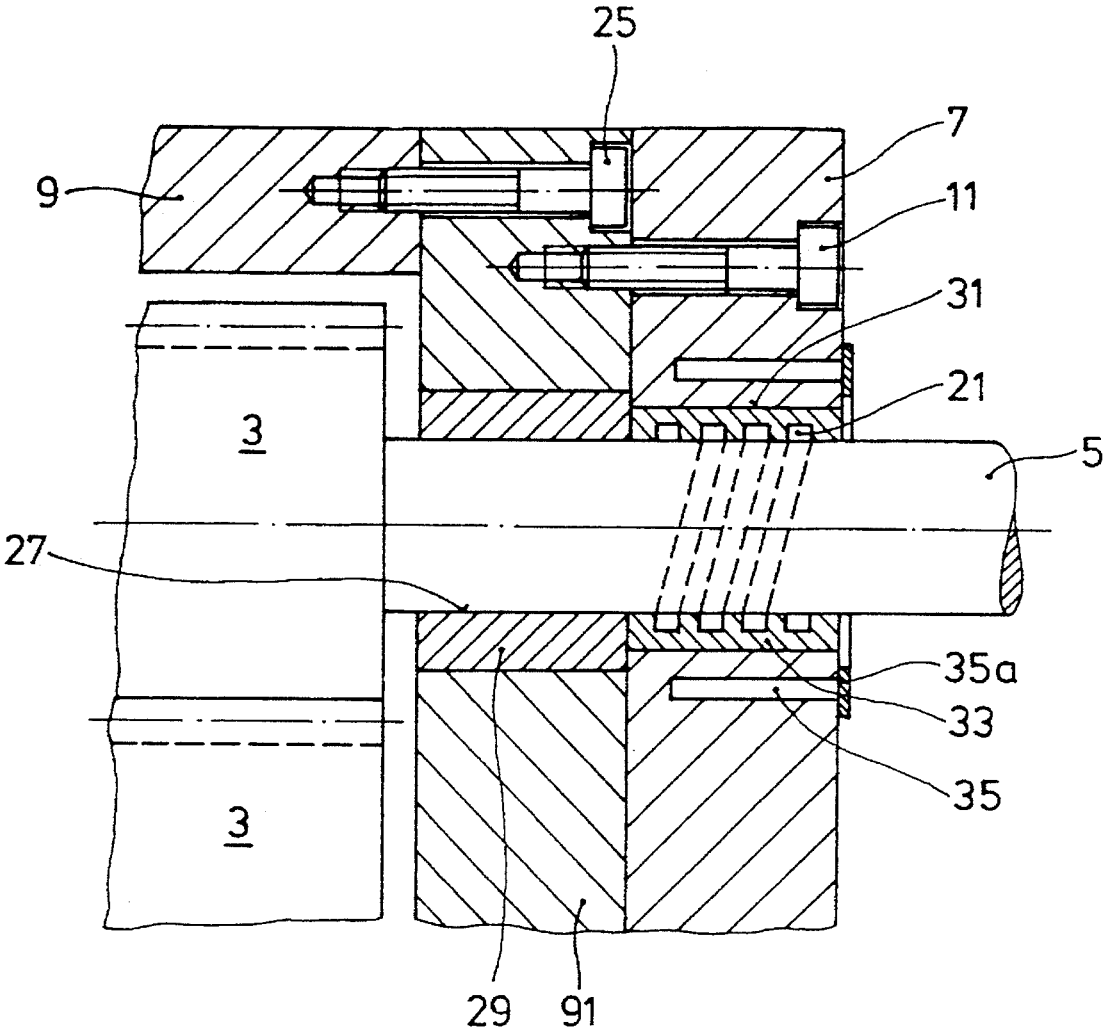
FIG. 1 is a schematic longitudinal sectional view of a first embodiment of the invention showing the gear pump in the area of the lead through of the pump rotor shaft.

The gear pump, which is not shown in its details, according to FIG. 1, has a central housing part 9 to which a lateral housing part 91 is connected by means of screw bolts 25 on the face side. The rotors 3, which are constructed as mating toothed wheels, rotate inside the housing, one of the rotors 3 being driven by means of the shaft 5. The lateral housing part 91 is provided with an opening 27 for the lead through of the shaft 5 of the rotor 3, which opening forms a bearing section with the bearing shells 29 for the shaft 5. The housing cover 7 is fastened axially on the lateral housing part 91 by means of screw bolts 11, which defines a corresponding bore 31 for the shaft 5 with a sealing section. A bush 33 is embedded in the bore 31 for the shaft 5. The bush 33, which is made of a material which differs from the material of the housing cover 7, such as a ceramic material, has a labyrinth seal 21 on its interior side which, as indicated by an interrupted line, is preferably constructed as a threaded shaft seal. The bush 33 is unreleasably anchored in the bore 31 of the housing cover 7, for example, by pressfitting or in a non-positive manner.

Compared with the previously known constructions, the shaft lead through according to the invention constructively and functionally separates the bearing section 27, 29 and the sealing section 21, 31. This permits the use of materials which are optimally adapted to the respective function (bearing or sealing). A surface sealing must be ensured only between the housing cover 7 and the housing part 91. The problem of such sealing surfaces between the bush 33 and the housing cover 7 is eliminated.

Figure 2:
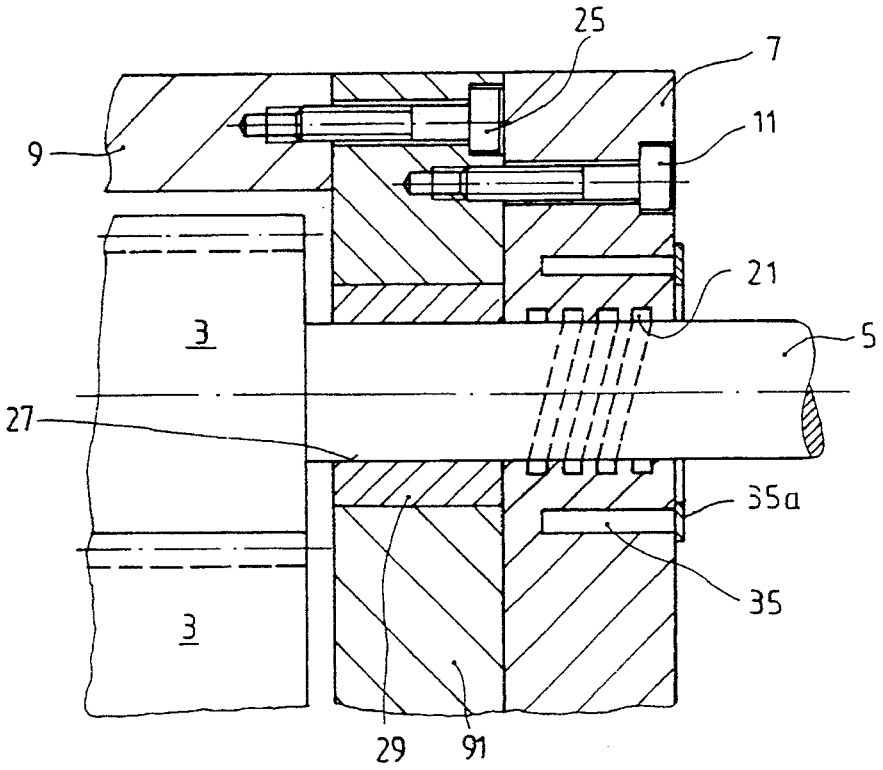
FIG. 2 is a representation which corresponds to FIG. 1 and shows another preferred embodiment of the invention.

FIG. 2 illustrates another preferred and simplified shaft lead through in which, based on the embodiment according to FIG. 1, the labyrinth seal 21 is worked directly into the housing cover 7 or its bore.

As illustrated in FIG. 1 and 2 at reference number 35, the housing cover 7 advantageously has a duct system 35 for a cooling medium which preferably, as illustrated, is closed of by an end plate 35*a*. As a result, the effect of the labyrinth seal can be optimally adapted to the respective delivered material.

Figure 3:
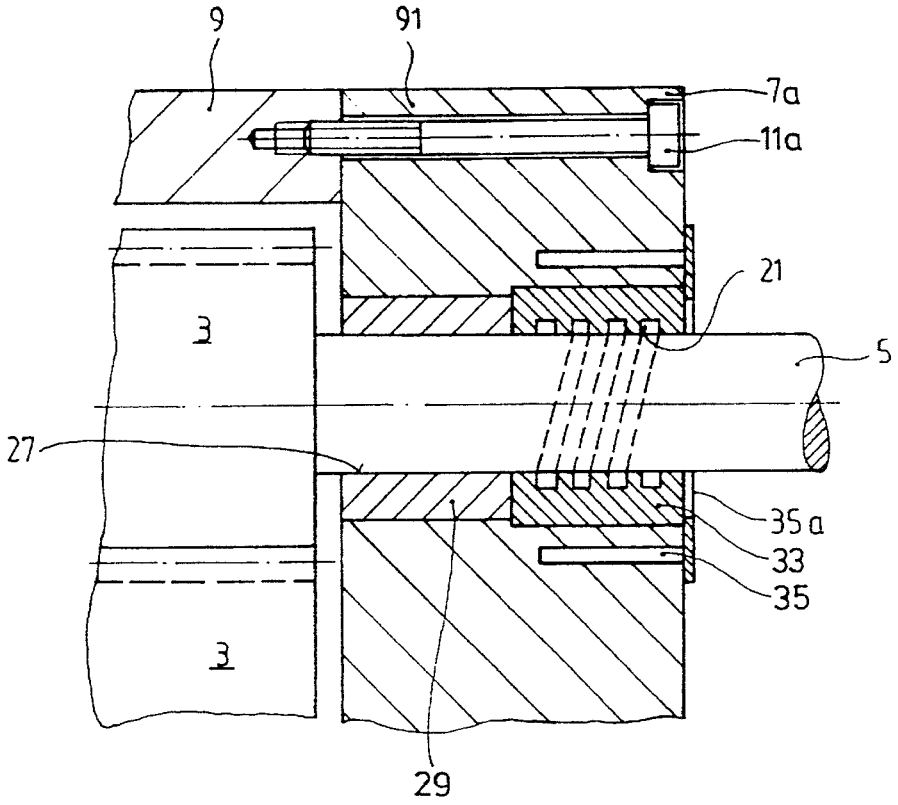
FIG. 3 is a representation which corresponds to FIGS. 1 and 2 and shows another preferred embodiment of the invention.

In the case of a further simplification according to FIG. 3, in which the surface between the housing cover 7 and the housing part 91 according to FIGS. 1, 2 is also eliminated, the following is shown in FIG. 3: The labyrinth seal 21 as well as the bearing shells 29 of the bearing section are arranged in a one-piece end plate 7*a* which is anchored to the housing part 9 by means of screw bolts 11*a*.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A gear pump comprising:

a housing for housing gear pump rotors, at least one of said gear pump rotors comprising a shaft being led to the outside of said housing through a bore in said housing, said bore comprising a shaft bearing section and a shaft sealing section arranged axially outwards of said bearing section with respect to a gear wheel of said at least one gear pump rotor, said sealing section being arranged in an end cover plate of said housing and comprising a labyrinth seal with a labyrinth machined into material of said end cover plate.

2. The gear pump of claim 1, further comprising a duct system for a cooling medium in said cover plate.

3. The gear pump of claim 2, said duct system comprising grooves open towards the outside and covered by at least one groove covering plate mounted to said end cover plate of said housing.

4. A gear pump comprising:

a housing for housing gear pump rotors, at least one of said gear pump rotors comprising a shaft being led to the outside of said housing through a bore in said housing, said bore comprising a shaft bearing section and a shaft sealing section arranged axially outwards of said bearing section with respect to a gear wheel of said at least one gear pump rotor, said sealing section and said bearing section being both provided in a unitary end cover plate of said housing, and a duct system for a cooling medium in said cover plate of said housing.

5. A gear pump, comprising:

a housing for housing gear pump rotors, at least one of said gear pump rotors comprising a shaft being led to the outside of said housing through a bore in said housing, said bore comprising a shaft bearing section and a shaft sealing section arranged axially outwards of said bearing section with respect to a gear wheel of said at least one gear pump rotor, said sealing section and said bearing section being both provided in a unitary end cover plate of said housing, wherein said sealing section comprises a labyrinth seal, wherein said labyrinth seal is machined into the material of a bushing residing within said bore of said cover plate of said housing, and wherein said bearing section comprises a bearing shell within said bore of said cover plate of said housing, the outer diameter of said bearing shell being smaller than the outer diameter of said bushing.

6. The gear pump of claim 5, further comprising a duct system for a cooling medium in said cover plate of said housing.

7. The gear pump of claim 6, wherein said duct system comprises grooves in said cover plate of said housing which are open towards the outside and are covered by a groove covering plate fixed to said cover plate of said housing.

8. The gear pump of claim 5, wherein said bushing is mounted in said bore of said cover plate of said housing by one of welding, glide fitting and of press fitting.

9. A method of making a gear pump of the type including a housing for housing gear pump rotors, at least one of said gear pump rotors comprising a shaft being led to the outside of said housing through a bore in a unitary cover plate of said housing, said bore comprising a shaft bearing section and a shaft sealing section arranged axially outwards of said bearing section with respect to a gear wheel of said at least one gear pump rotor, said method comprising providing both said sealing section and said bearing section in the unitary cover plate of said housing, and providing a duct system for a cooling medium in said cover plate of said housing.

10. The method of claim 9, wherein said sealing section comprises a labyrinth seal, said method comprising machining said labyrinth seal into material of a bushing and inserting the bushing within said bore of said cover plate of said housing.

11. A method of making a gear pump of the type including a housing for housing gear pump rotors, at least one of said gear pump rotors comprising a shaft being led to the outside of said housing through a bore in a unitary cover plate of said housing, said bore comprising a shaft bearing section and a shaft sealing section arranged axially outwards of said bearing section with respect to a gear wheel of said at least one gear pump rotor, said method comprising providing both said sealing section and said bearing section in the unitary cover plate of said housing, and wherein said sealing section comprises a labyrinth seal, said method comprising machining said labyrinth seal into material of a bushing and inserting the bushing within said bore of said cover plate of said housing, and providing said bearing section in a bearing shell within said bore of said cover plate of said housing, the outer diameter of said bearing shell being smaller than the outer diameter of said bushing.

12. The method of claim 11, further comprising providing a duct system for a cooling medium in said cover plate of said housing.

13. The method of claim 12, wherein said duct system comprises grooves in said cover plate of said housing which are open towards the outside, comprising covering said grooves by a groove covering plate fixed to said cover plate of said housing.

14. The method of claim 11, comprising mounting said bushing in said bore of said cover plate of said housing by one of welding, glide fitting and of press fitting.

15. A method of making a gear pump of the type including a housing for housing gear pump rotors, at least one of said gear pump rotors comprising a shaft being led to the outside of said housing through a bore in a unitary cover plate of said housing, said bore comprising a shaft sealing section, said method comprising machining a labyrinth seal for said shaft into the material of said unitary cover plate.

* * * * *

UNITED STATES PATENT AND TRADEMARK OFFICE

CERTIFICATE OF CORRECTION

PATENT NO. : 5,462,420

DATED : October 31, 1995

INVENTOR(S) : Roger Stehr and Urs Boelsterli

It is certified that error appears in the above-indentified patent and that said Letters Patent is hereby corrected as shown below:

On the title page, Item [56]
Please change the foreign application priority data to reflect the country as Fed. Rep. Germany.

Signed and Sealed this

Fifth Day of March, 1996

Bruce Lehman

*Attest:*

BRUCE LEHMAN

*Attesting Officer*

*Commissioner of Patents and Trademarks*